US011396753B1

(12) United States Patent
Hradisky et al.

(10) Patent No.: US 11,396,753 B1
(45) Date of Patent: Jul. 26, 2022

(54) FINISHING SHINGLE

(71) Applicants: Michael John Hradisky, Dallas, TX (US); Andrew Hradisky, Dallas, TX (US)

(72) Inventors: Michael John Hradisky, Dallas, TX (US); Andrew Hradisky, Dallas, TX (US)

( * ) Notice: Subject to any disclaimer, the term of this patent is extended or adjusted under 35 U.S.C. 154(b) by 0 days.

(21) Appl. No.: 17/149,965

(22) Filed: Jan. 15, 2021

Related U.S. Application Data

(60) Provisional application No. 62/961,541, filed on Jan. 15, 2020.

(51) Int. Cl.

| | |
|---|---|
| ***E04D 1/26*** | (2006.01) |
| ***E04D 13/147*** | (2006.01) |
| *E04D 1/34* | (2006.01) |
| *E04D 1/20* | (2006.01) |

(52) U.S. Cl.
CPC ..... *E04D 1/26* (2013.01); *E04D 13/1478* (2013.01); *E04D 1/20* (2013.01); *E04D 2001/3423* (2013.01); *E04D 2001/3435* (2013.01); *E04D 2001/3491* (2013.01)

(58) Field of Classification Search
CPC ..... E04D 1/26; E04D 1/20; E04D 2001/3491; E04D 2001/3435; E04D 13/14–13/1478; E04D 2001/3423
See application file for complete search history.

(56) References Cited

U.S. PATENT DOCUMENTS

| | | | | | |
|---|---|---|---|---|---|
| 4,404,783 | A * | 9/1983 | Freiborg | E04D 1/26 | 52/98 |
| 4,439,955 | A * | 4/1984 | Freiborg | E04D 1/20 | 52/57 |
| 4,587,785 | A * | 5/1986 | Rohner | E04D 1/29 | 52/543 |
| 4,920,721 | A * | 5/1990 | Pressutti | E04D 1/30 | 52/518 |
| 5,094,042 | A * | 3/1992 | Freborg | E04D 1/20 | 52/748.1 |
| 5,195,290 | A * | 3/1993 | Hulett | E04D 1/28 | 52/518 |
| 5,895,536 | A * | 4/1999 | Starr | E04D 1/29 | 156/291 |
| 6,035,595 | A * | 3/2000 | Anderson | E04F 13/045 | 411/258 |
| 6,206,991 | B1 * | 3/2001 | Starr | E04D 1/29 | 156/291 |
| 6,209,283 | B1 * | 4/2001 | Folkersen | E04D 13/1478 | 52/746.11 |

(Continued)

*Primary Examiner* — Adriana Figueroa
(74) *Attorney, Agent, or Firm* — Kenneth L. Tolar

(57) ABSTRACT

A finishing shingle includes a sheet having a front surface and a rear surface. The front surface is configured to resemble the shingle installed on a roof with which the finishing shingle will be used. The sheet further includes a central, frangible seam longitudinally extending from one side edge to an opposing side edge that allows a worker to easily separate the sheet into two equal finishing shingles that are substantially half the size of the roof shingle. Nail targets positioned on the top surface provide a template for a worker to nail the finishing shingle to the underlying flashing. Circular sealant patches on the rear surface are aligned with the nail targets to form a watertight seal around the nail and flashing.

6 Claims, 5 Drawing Sheets

(56) References Cited

U.S. PATENT DOCUMENTS 6,494,010 B1 * 12/2002 Brandon ..... E04D 1/20 52/518
7,281,358 B2 * 10/2007 Floyd ..... E04D 1/26 52/518
8,173,243 B2 * 5/2012 Kalkanoglu ..... E04D 1/34 428/143
8,898,963 B1 * 12/2014 Amatruda ..... E04D 1/2963 52/409
8,925,272 B1 * 1/2015 Amatruda ..... E04D 1/2963 52/557
9,540,821 B2 * 1/2017 Houchin ..... B32B 27/12
10,364,573 B2 * 7/2019 Folkersen ..... E04D 5/00
2003/0089445 A1 * 5/2003 Faulkner ..... B32B 5/18 156/71
2004/0074187 A1 * 4/2004 Timbrel ..... E04D 1/26 52/518
2004/0093806 A1 * 5/2004 Mares ..... E04D 13/1478 52/62
2004/0111996 A1 * 6/2004 Heroneme ..... B32B 7/04 52/518
2005/0183345 A1 * 8/2005 Allen ..... E04D 13/1478 52/58
2005/0252140 A1 * 11/2005 Faulkner ..... E04D 1/34 52/542
2008/0010933 A1 * 1/2008 Faulkner ..... B32B 5/18 52/411
2008/0185748 A1 * 8/2008 Kalkanoglu ..... B29C 48/175 264/46.6
2011/0005158 A1 * 1/2011 Kailey ..... E04D 1/20 52/518
2013/0025224 A1 * 1/2013 Vermilion ..... E04D 1/26 52/309.2
2015/0240496 A1 * 8/2015 Grubka ..... E04D 1/29 428/189
2017/0306627 A1 * 10/2017 Grubka ..... E04D 1/30
2019/0161970 A1 * 5/2019 Strickland ..... E04D 1/36
2020/0040582 A1 * 2/2020 Boss ..... E04D 1/20

* cited by examiner

FINISHING SHINGLE

CROSS REFERENCE TO RELATED APPLICATIONS

This application claims priority of provisional application No. 62/961,541 filed on Jan. 15, 2020, the specification of which is incorporated herein by reference.

BACKGROUND OF THE INVENTION

The present invention relates to a finishing shingle that allows a user to decoratively conceal apron flashings on a shingled roof.

DESCRIPTION OF THE PRIOR ART

The joint between roofing shingles and chimneys or dormers is highly susceptible to water intrusion that can enter the attic or dwelling. Therefore, an apron flashing is typically secured over the joint by sealing a portion to the chimney and extending it a predetermined distance over the adjacent shingles. Flashing is often constructed with a shiny, silvery metal that is unsightly, unpleasantly contrasts with the shingle appearance, and diminishes the aesthetic quality of the shingled roof. Furthermore, if the lower edge of the flashing is not accurately cut to align with the adjacent shingle course, the roof's appearance is further diminished.

Accordingly, there is currently a need for a device that eliminates the unsightliness associated with visible roof flashing. The present invention addresses this need by providing a finishing shingle that resembles a conventional shingle for overlaying exposed roof flashing. The finishing shingle not only decoratively conceals the apron flashing, but also protects it from impact damage caused by hailstorms and similar events.

SUMMARY OF THE INVENTION

The present invention relates to a finishing shingle comprising a sheet having a front surface and a rear surface. The front surface is configured to resemble a conventional shingle installed on a roof with which the finishing shingle will be used. The sheet further includes a central, frangible seam longitudinally extending from one side edge to an opposing side edge that allows a worker to easily separate the sheet into two equal finishing shingles that are substantially half the size of a conventional shingle. Nail targets positioned on the top surface provide a template for a worker to nail the finishing shingle to the underlying flashing. Circular sealant patches on the rear surface are aligned with the nail targets to form a watertight seal around the nail and flashing.

It is therefore an object of the present invention to provide a finishing shingle that conceals unsightly roof flashing.

It is therefore another object of the present invention to provide a finishing shingle that resembles a select conventional roof shingle.

It is yet another object of the present invention to provide a finishing shingle that is easily separable into two finishing shingles that are each half the size of a conventional shingle.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
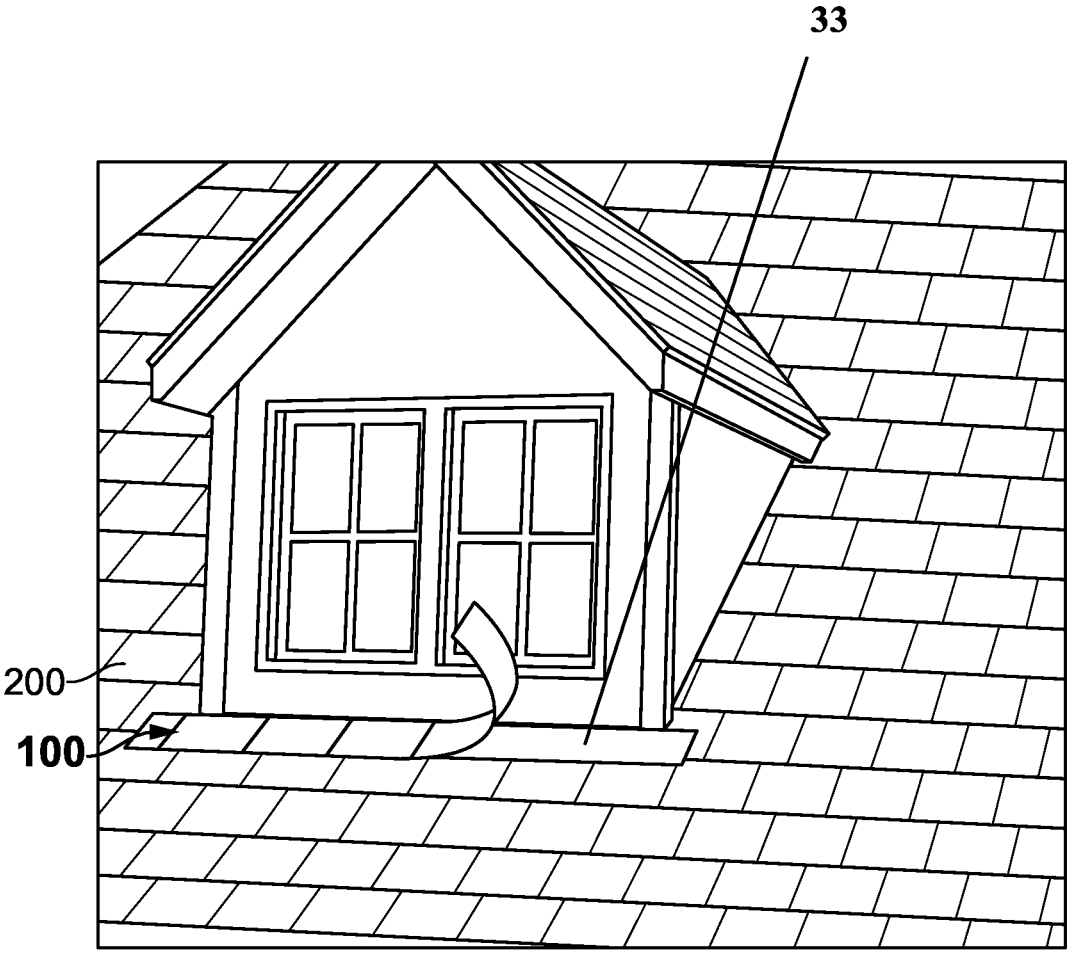
FIG. 1 depicts the finishing shingle according to the present invention being mounted on a roof.
Figure 2:
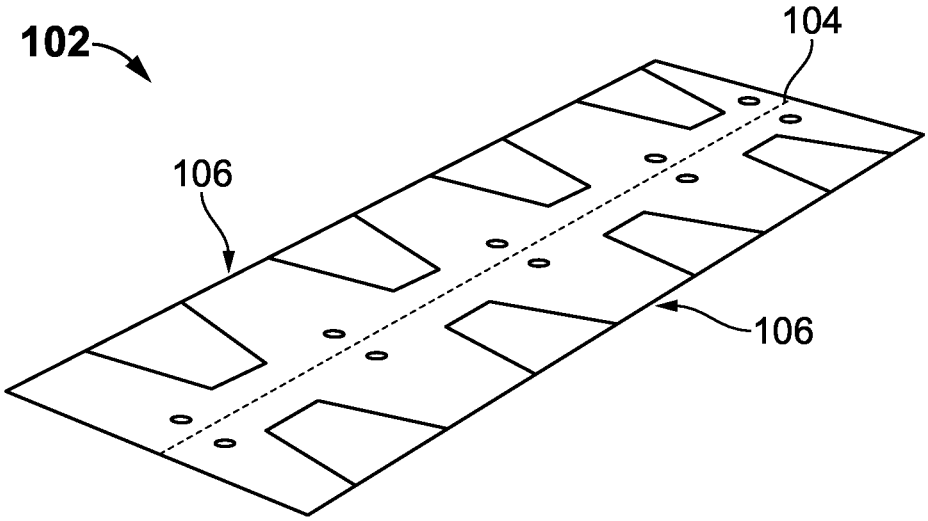
FIG. 2 is a perspective view of an architectural-style finishing shingle according to the present invention.
Figure 3:
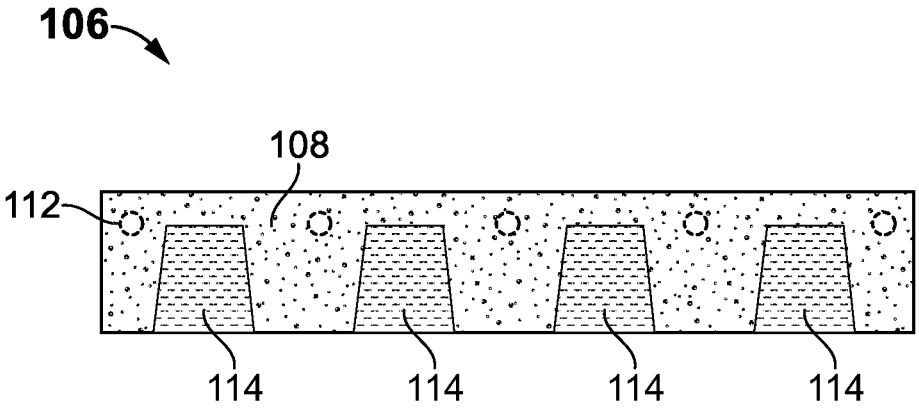
FIG. 3 is a top view of the architectural-style finishing shingle.
Figure 4:
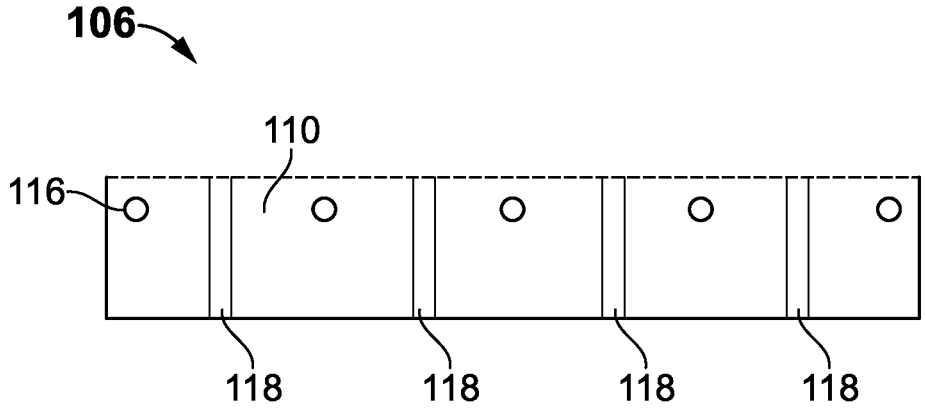
FIG. 4 is a bottom view of the architectural-style finishing shingle.
Figure 5:
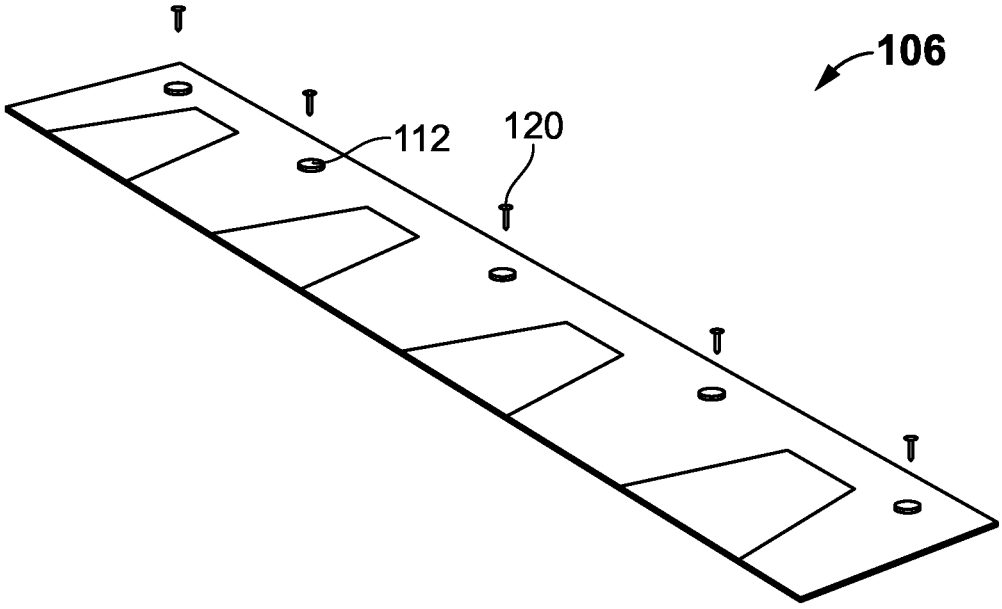
FIG. 5 is a perspective view of the architectural-style finishing shingle.

The present invention relates to a finishing shingle 100 for covering and decoratively concealing exposed apron flashing 33 on a shingled roof 200. The top or front surface of the finishing shingle is configured to resemble a conventional shingle installed on a given roof with which the finishing shingle will be used. The shingle is constructed similarly as conventional shingles and includes a fiberglass base layer infused with a binder and an asphalt material. The base layer is then dusted with a light coating of powdered material and ceramic coated materials are applied to the top surface. The ceramic-coated materials are preferably identical to or an equivalent of the ceramic-coated materials on the shingled roof 200. The shingle exterior can be configured to resemble a 3-tab shingle 122, or an architectural-style shingle 102 which resembles more traditional roofing materials, such as cedar shakes or slate tiles.

Referring to FIGS. 1-5, the architectural-style finishing shingle 102 comprises a sheet having a front surface 108, a rear surface 110, two opposing side edges, an upper edge, and a lower edge. The sheet further includes a central, frangible seam 104 longitudinally extending from one side edge to the opposing side edge. The frangible seam 104 allows a worker to easily separate the sheet into two equal shingles 106 that are substantially half the size of a conventional shingle. For example, a conventional shingle is approximately 12-13⅞"×36" while the resulting finishing shingle will be approximately 6-7"×36." The resulting equally sized shingles can then be used to cover the apron flashing 33 or could be used as a starter course shingle. Accordingly, one half of the sheet is a mirror image of the other half to form two identically configured finishing shingles when the sheet sections are separated.

Circular nail targets 112 positioned on the front surface, near the upper edge, provide a template for a worker to nail the finishing shingle to the underlying flashing. The front surface may also include tabs or aesthetic patterns 114 having equal or varying dimensions to resemble certain architectural-style roof shingles. On the rear surface are a series of circular sealant patches 116 aligned with the nail targets that form a watertight seal around the nail 120 as it is driven into the flashing. The sealant prevents moisture from seeping through the finishing shingle, flashing and roof structure. Preferably, the sealant patches are each covered with a protective layer that maintains sealant integrity during transport and handling. The rear surface also includes one or more parallel strips 118 of heat-activated adhesive to further bind the sheet to the flashing to prevent displacement by wind or other forces.

Figure 6:
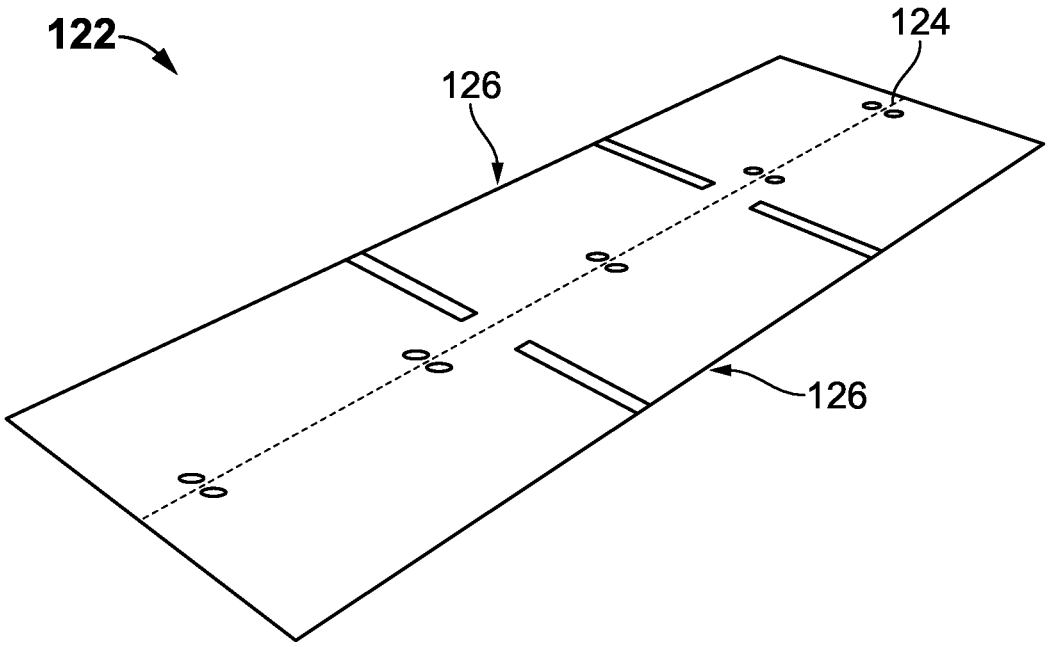
FIG. 6 is a perspective view of a standard 3-tab style finishing shingle according to the present invention.
Figure 7:
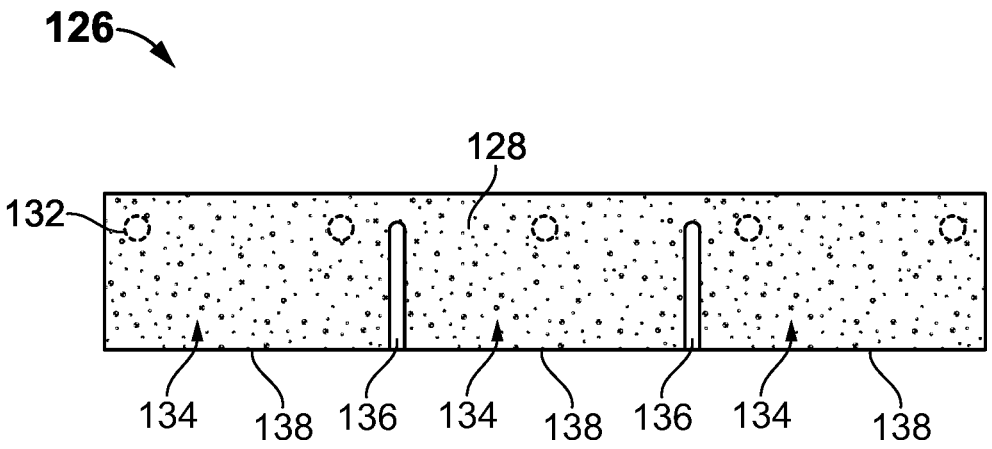
FIG. 7 is a top view of the 3-tab style finishing shingle.
Figure 8:
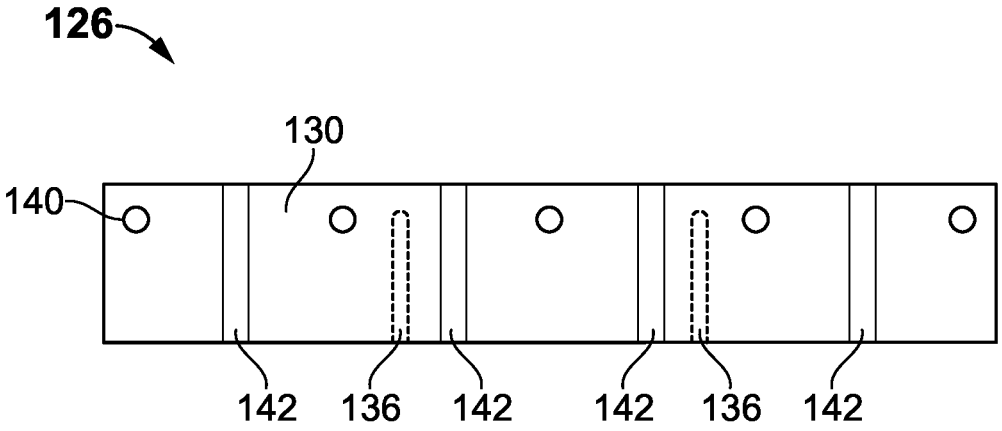
FIG. 8 is a bottom view of the 3-tab style finishing shingle.

Now referring to FIGS. 6-8, the front surface of the finishing shingle 122 could resemble a conventional three-tab shingle having a front surface 128, a rear surface 130, two opposing side edges, an upper edge, and a lower edge 138. The sheet further includes a central, frangible seam 124 longitudinally extending from one side edge to the opposing side edge. The frangible seam allows a worker to easily separate the sheet into two equal shingles 126 that are substantially half the size of a conventional shingle. For example, a conventional shingle is approximately 12-13⅞"× 36" while the resulting finishing shingle will be approximately 6-7"×36." The resulting, equally sized shingles can then be used to cover the apron flashing 33 or could be used as a starter course shingle. The rear surface also includes one or more parallel strips 142 of heat-activated adhesive to bind the sheet to the flashing to prevent displacement by wind or other forces.

Circular nail targets 132 positioned on the front surface, near the upper edge, provide a template for a worker to nail the finishing shingle to the underlying flashing. On the rear surface are a series of circular sealant patches 140 aligned with the nail targets that form a watertight seal around the nail 120 as it is driven into the flashing. Preferably, the sealant patches are each covered with a protective layer that maintains sealant integrity during transport and handling.

The front surface may also include false tabs or similar patterns 134 having equal or varying dimensions to resemble 3-tab roof shingles. Between each pair of tabs is a faux slot 136 formed of black ceramic-coated materials that resemble the equally spaced slots on the conventional shingle.

The above-described device is not limited to the exact details of construction and enumeration of parts provided herein. Although the finishing shingle has been depicted and described as resembling two discrete types of shingles, it can resemble virtually any type of known shingle. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a roof having shingles thereon having a select aesthetic exterior surface, an architectural object extending from said roof, and exposed flashing positioned between said architectural object and said roof shingles, a finishing shingle for concealing said flashing comprising:

a sheet having a front surface and a rear surface, a pair of longitudinal edges and a pair of transverse edges, said front surface aesthetically configured to resemble said select aesthetic exterior surface, said sheet superimposed on said exposed flashing;

spaced targets positioned on the front surface of said sheet that provide a template for a worker to drive a nail into said sheet and said exposed flashing;

a plurality of sealant patches on the rear surface of said sheet, each of said sealant patches aligned with a select one of said spaced targets, said sealant patches forming a watertight seal between said nail and said flashing;

a plurality of heat-activated adhesive strips on the rear surface of said sheet extending in a transverse direction between said pair of longitudinal side edges to bind the sheet to the flashing.

2. The combination according to claim 1 wherein said sheet further comprises a frangible seam longitudinally extending from a first side edge to an opposing side edge that allows a worker to separate the sheet into two finishing shingles that are smaller than each of said roof shingles.

3. The combination according to claim 2 wherein the front surface of said sheet includes false patterns that resemble a pattern on an exterior surface of said roof shingles.

4. The combination according to claim 3 further comprising at least one faux slot on the front surface of said sheet to resemble a select roofing shingle.

5. The combination according to claim 1 wherein said sheet is substantially the same size as each of the roof shingles.

6. The combination according to claim 1 wherein said sealant patches are each covered with a protective layer that maintains sealant integrity during storage, transport, and handling.

* * * * *